US006237447B1

(12) United States Patent
Chen et al.

(10) Patent No.: US 6,237,447 B1
(45) Date of Patent: May 29, 2001

(54) ONE-WAY DRIVING CONTROL MECHANISM OF A WRENCH

(76) Inventors: Chyn-Huei Chen; Shiou-Yih Chen, both of No. 36, Alley 37, Lane 76, Sec. 1st, Shing-Long Rd., Tai-Ping City, Taichung Hsien (TW)

( * ) Notice: Subject to any disclaimer, the term of this patent is extended or adjusted under 35 U.S.C. 154(b) by 0 days.

(21) Appl. No.: 09/598,031

(22) Filed: Jun. 21, 2000

(51) Int. Cl.[7] ..... B25B 13/46
(52) U.S. Cl. ..... 81/63.1
(58) Field of Search ..... 81/60–63.2, 58.5, 81/59.1; 192/45.1, 43

(56) References Cited

U.S. PATENT DOCUMENTS 5,199,329 * 4/1993 Hsu ..... 81/59.1
5,509,332 * 4/1996 Donaldson ..... 81/59.1
5,533,427 * 7/1996 Chow ..... 81/63.2
5,537,899 * 7/1996 Diedrich ..... 81/62
5,957,009 * 9/1999 McCann ..... 81/63.2

* cited by examiner

*Primary Examiner*—D. S. Meislin
(74) *Attorney, Agent, or Firm*—Rosenberg, Klein & Lee

(57) ABSTRACT

The invention relates to a one-way driving control mechanism of a wrench, which comprises a wrench body, a spinner element, a diameter-variable grommet and a pawl. The head portion of the wrench body has a housing for placing a spinner element, a diameter-variable grommet and a pawl. The middle portion of the spinner element takes the shape of an elliptic cylinder. A diameter-variable grommet consisting of two movable separate segments is set around the circumference of the cylinder. The outside diameter of such a diameter-variable grommet is slightly smaller than the inside diameter of the housing. With twisting the wrench, the spinner element rotates relatively to the wrench body, and then the elliptic cylinder pushes the diameter-variable grommet outward, which make one segment of the grommet jam against the wall of the housing to get one-way fastening. As a result, such a wrench is capable of achieving the virtues of simplifying mechanism and increasing torque.

5 Claims, 8 Drawing Sheets

ONE-WAY DRIVING CONTROL MECHANISM OF A WRENCH

FIELD OF THE INVENTION

The invention relates to a one-way driving control mechanism of a wrench, and more particularly to a one-way driving control mechanism of a wrench with an elliptical spinner element, a diameter-variable grommet and a pawl in the housing of its head. When the spinner element rotates the body of the wrench, a pawl is jammed on one side of the housing by spinner element to perform one-way driving. That is, the spinner element can rotate relatively to the wrench body to make one segment of the grommet jam against the wall of the housing to get one-way fastening. Thus the wrench body can drive the spinner element in one direction for screwing a screw nut or screw bolt. Therefore the one-way driving control mechanism of a wrench according to the invention has a simpler mechanism and greater torque.

BACKGROUND OF THE INVENTION

The well-known one-way driving control mechanism of a wrench are described as following, a called D-head ratchet wrench is disclosed in U.S. Pat. No. 5,537,899, which is characterized by an inner peripheral surface having an annual groove in its housing and a pawl with teeth in each of two ends of a driving head. The driving head establishes a one-way rotation by controlling that the pawl in one end engages with the annular groove of a body. Furthermore, a reverse rotation can be established by rotating a chucking block to make the pawl in the other end engaging with the annular groove. Thus, a one-way driving control in a reverse direction can be performed. A called calabash-form ratchet wrench, is disclosed in U.S. Pat. Nos. 5,957,009 and 5,533,427. This kind of ratchet wrench, which includes an annular groove in the inner peripheral surface of a driving head and a suitable pawl having teeth, in fundamental, is similar to that of the above-mentioned patent. Thus, the function of one-way rotation can be achieved by engaging the pawl with the annular groove in inner peripheral surface. Further, a called non-noise ratchet wrench is disclosed in U.S. Pat. Nos. 5,941,140 and 5,884,537, which is constituted with a rolling body, a spring and non-regular surface. The rolling body jams with and looses from the non-regular surface of the housing to establish the one-way driving control. Unlike former above-mentioned ratchet wrenches, the last type of ratchet wrench does not appear the phenomenon of jumping teeth, and hence has no noise. However, for the ratchet wrench having the annular groove engaged with a pawl, its disadvantages include complicated mechanism, high manufacturing cost, and causing jumping teeth noise. And the non-noise ratchet wrench has too many components, and is also with high manufacture cost as well as small torque.

SUMMARY OF THE INVENTION

The primary objective of the invention is to provide a wrench of simple mechanism, low cost, no-noise driving and big torque. According to the invention, the one-way driving control mechanism of a wrench comprises a wrench body, a spinner element, a diameter-variable grommet and a pawl. The head portion of the wrench body has a housing for placing a spinner element, a diameter-variable grommet and a pawl. The middle portion of the spinner element takes the shape of an elliptic cylinder. A diameter-variable grommet consisting of two movable separate segments is set around the circumference of the cylinder. The outside diameter of such a diameter-variable grommet is slightly smaller than the inside diameter of the housing. With twisting the wrench, the spinner element rotates relatively to the wrench body, and then the elliptic cylinder pushes the diameter-variable grommet outward, which make one segment of the grommet jam against the wall of the housing to get one-way fastening. As a result, such wrench is capable of achieving the virtues of simplifying mechanism, reducing manufacture cost, having no noise and increasing torque.

PREFERRED EMBODIMENTS OF THE INVENTION

Figure 1:
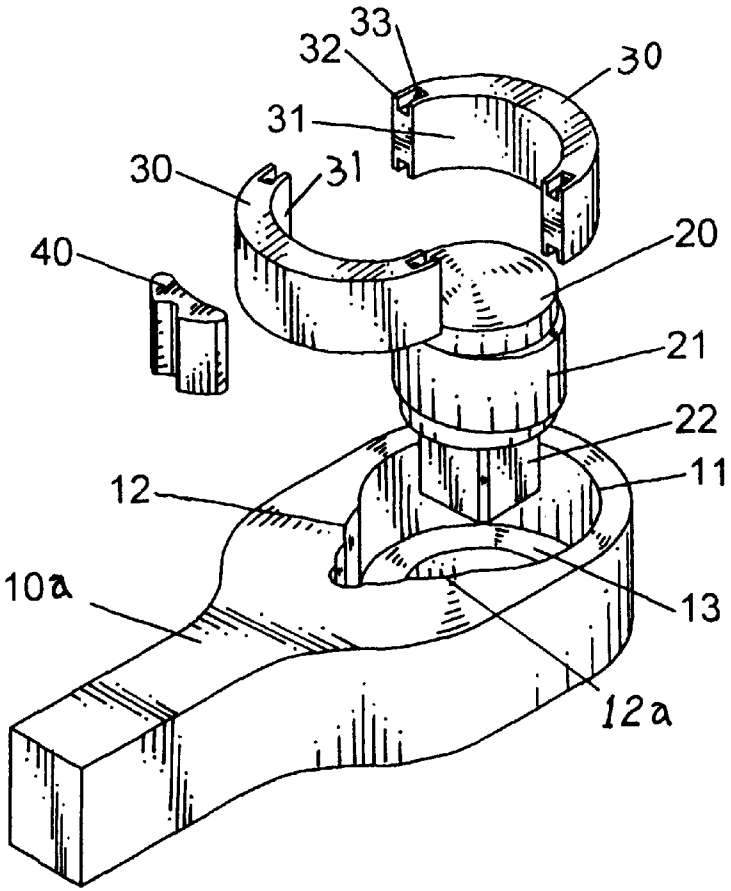
FIG. 1 is an exploded 3D view of the wrench according to the invention.
Figure 2:
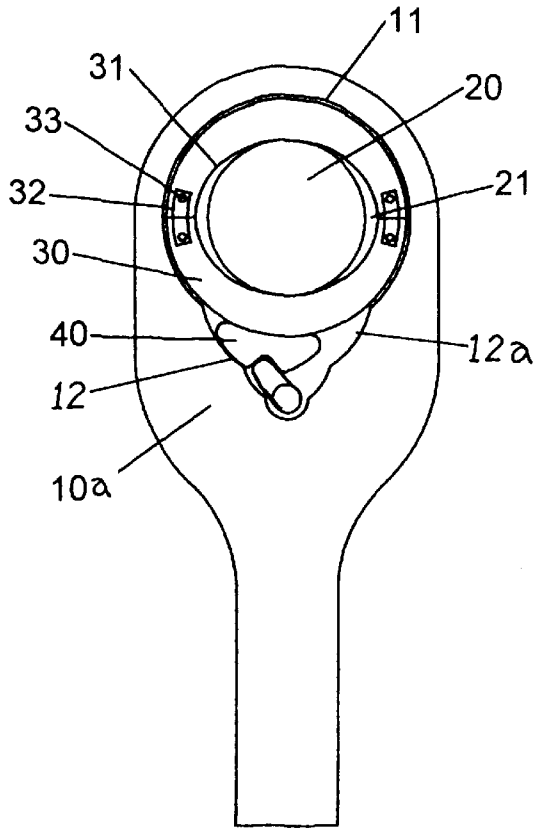
FIG. 2 is schematic view of the wrench in the ordinary position according to the invention.

Referring to FIG. 1 and FIG. 2, the wrench in accordance with the invention comprises a wrench body 10*a*, a spinner element 20, a diameter-variable grommet 30 and a pawl 40. The grommet 30 may be composed of a plurality of separate sections, and as an example, a grommet with two separate sections is described in the embodiment. The head portion of the wrench body 10 has a housing 11 for placing the spinner element 20, the diameter-variable grommet 30 and the pawl 40. The sidewall of the housing 11 with grooves, called as the groove wall 12, is designed for jamming with the pawl 40. The middle segment of the spinner element 20 takes the shape of non-circular cylinder (for an example, an elliptic cylinder 21 used in the preferable embodiment), and is encircled with the diameter-variable grommet 30. The outside diameter of the diameter-variable grommet 30, which has an cambered interior surface 31, is slightly smaller than the inside diameter of the housing 11 in the wrench body 10. For the pawl 40 adjacent to the external side of the grommet 30, of which one side contacts with the external side of the grommet 30 and the other supports to the groove wall 12 of the housing 11.

Figure 7:
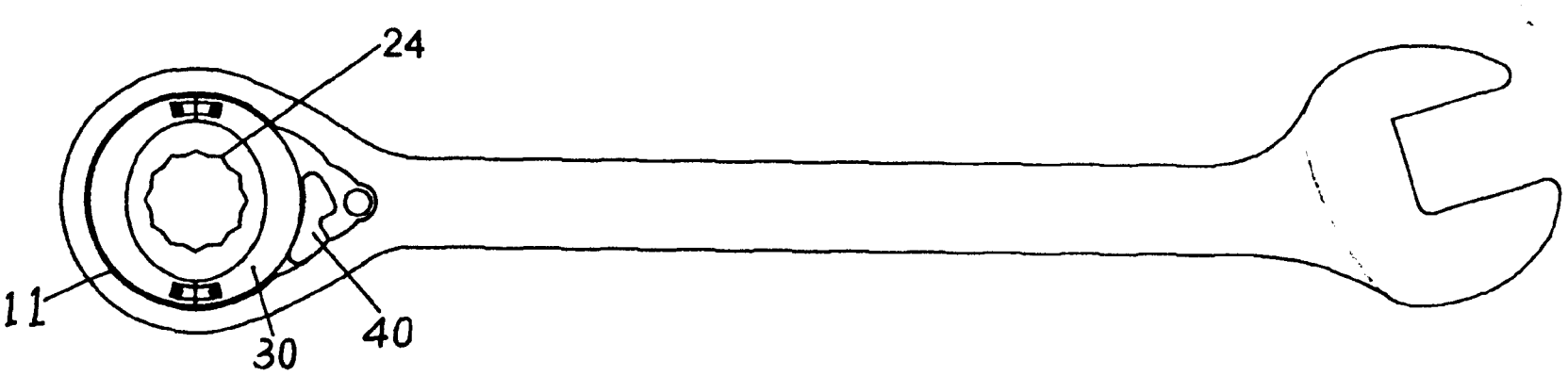
FIG. 7 is a schematic view of the invention in application to a double offset ring wrench.
Figure 8:
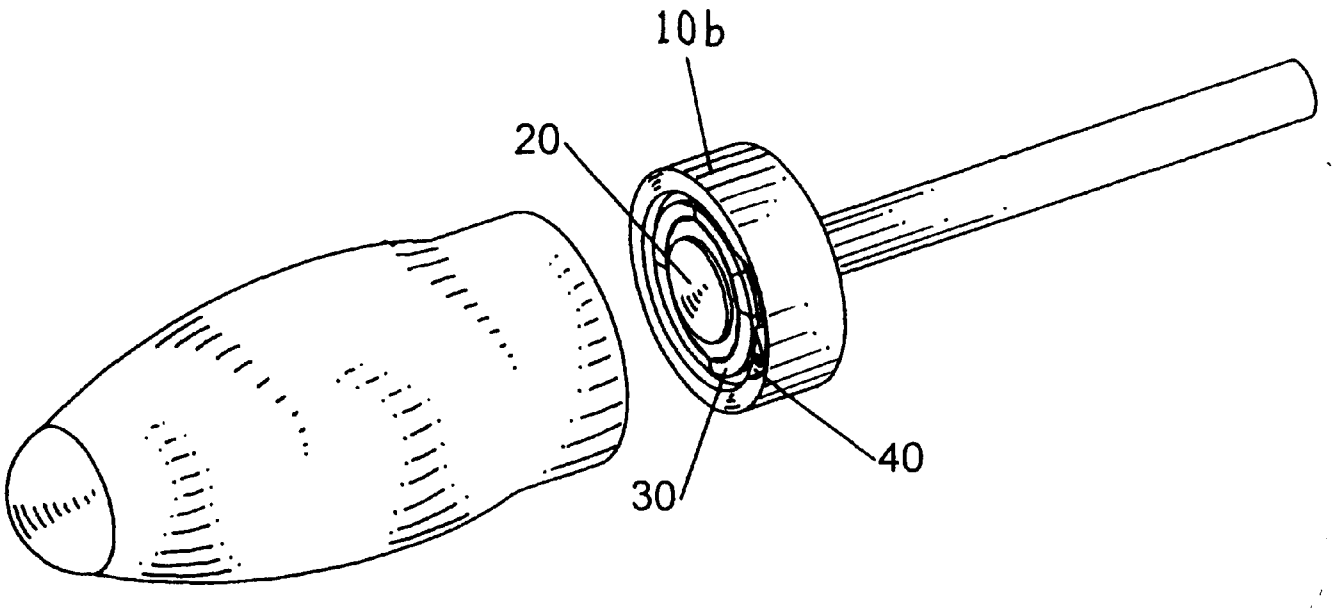
FIG. 8 is a schematic view of the invention in application to a screwdriver.

Further, referring to FIG. 7, the invention can be in application to the double offset ring wrench having a hollow nut 40 of a plurality of internal teeth. Seeing as shown in FIG. 8, the invention can be in application to a screwdriver body 10*b*, its function is similar to that of the wrench.

Referring to FIG. 1 and FIG. 2, the assembly of the wrench according to the invention is described as follows. First, the diameter-variable grommet 30 encircles the elliptic cylinder 21 of the spinner element 20, and then they, as a whole, are installed within the housing 11 of the wrench body 10. The caliber of a step edge 13 at the bottom of the housing II is slightly smaller than the minimum diameter of the spinner element 20, so that the diameter-variable grommet 30 and the spinner element 20 can position effectively in the housing 11. Second, the pawl 40 is placed in the housing 11 and supports to the groove wall 12. Finally, the spinner element 20, the diameter-variable grommet 30 and the pawl 40 are sealed within the housing 1.

Figure 3:
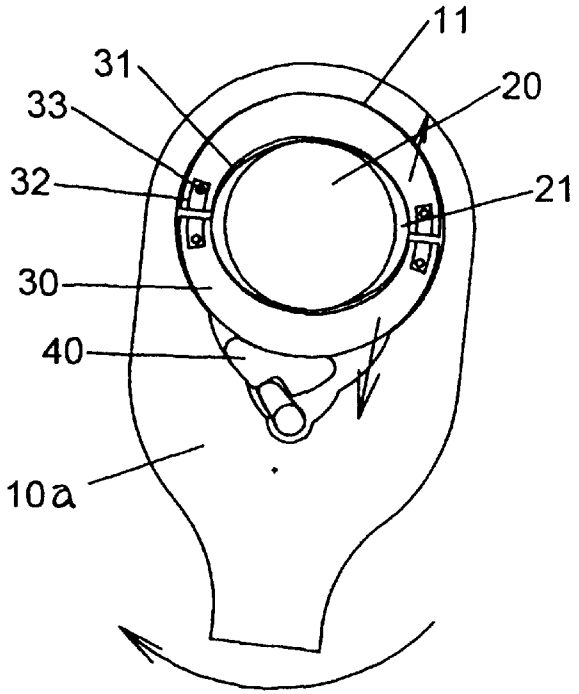
FIG. 3 is schematic view of the wrench in the rotating position according to the invention.

Referring to FIG. 2 and FIG. 3, when the spinner element 20 tightens a screw bolt, user twists the wrench body 10*a* through an angle by his hand, the spinner element 20 rotates relatively to the wrench body 10*a*. Thus, the elliptic cylinder 21 of the spinner element 20 pushes the diameter-variable grommet 30 outward, and further the pawl 40 jams against the groove wall 12 of the housing 11. The spinner element 20 rotates synchronously with the wrench body to screw the screw bolt up or off. When the wrench body 10*a* is twisted in a reverse direction, the elliptic cylinder 21 have no longer to push the diameter-variable grommet 30 outward, and further the grommet 30 does not jam the pawl 40 again. Thus, the reverse operation can not make the screw bolt screwed tightly or loosely. Consequently, one-way driving control can be established.

Figure 4:
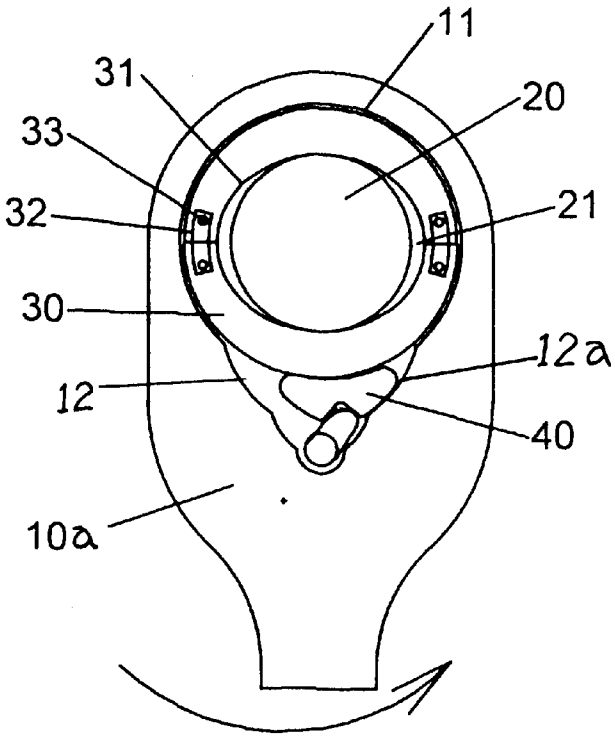
FIG. 4 is a schematic view of the wrench with one-way control in an opposite rotating direction according to the invention.

Referring to FIG. 4, another symmetrical groove wall may be formed in the housing 11 in accordance with the invention. A direction control element 41, connecting with the pawl 40, can control the pawl 40 to move to the other groove wall 12*a*. Thus, one-way driving control in a reverse direction can be achieved.

Figure 5:
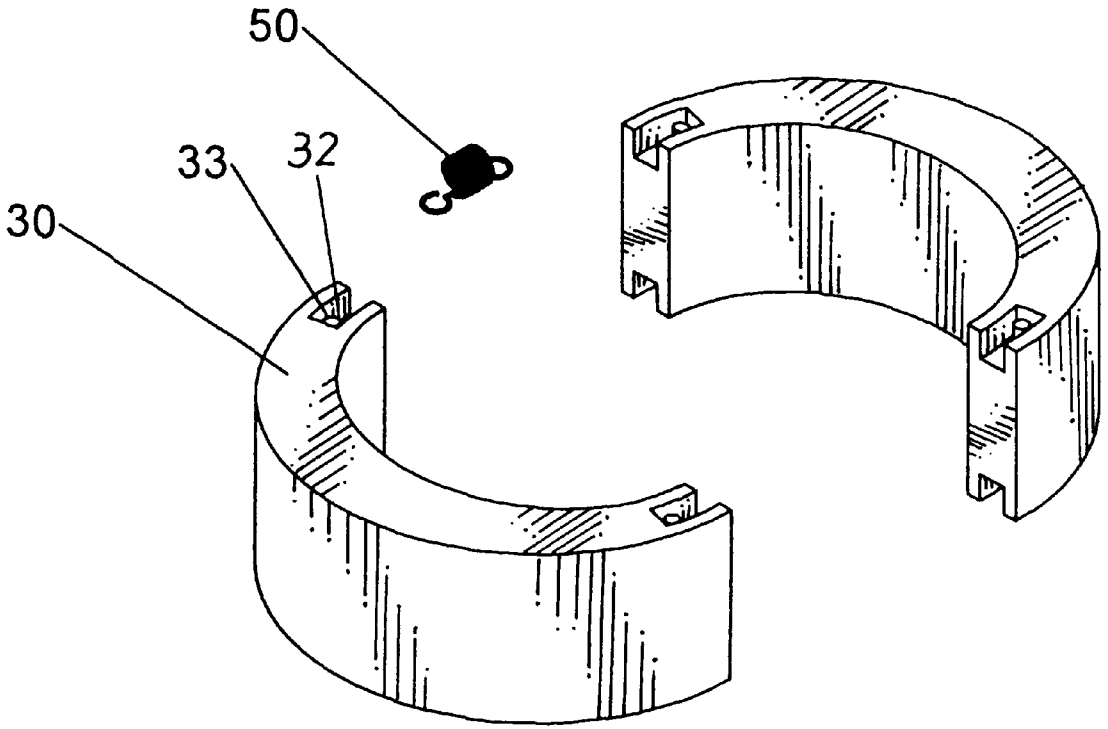
FIG. 5 is a schematic view of the grommet with springs according to the invention.
Figure 6:
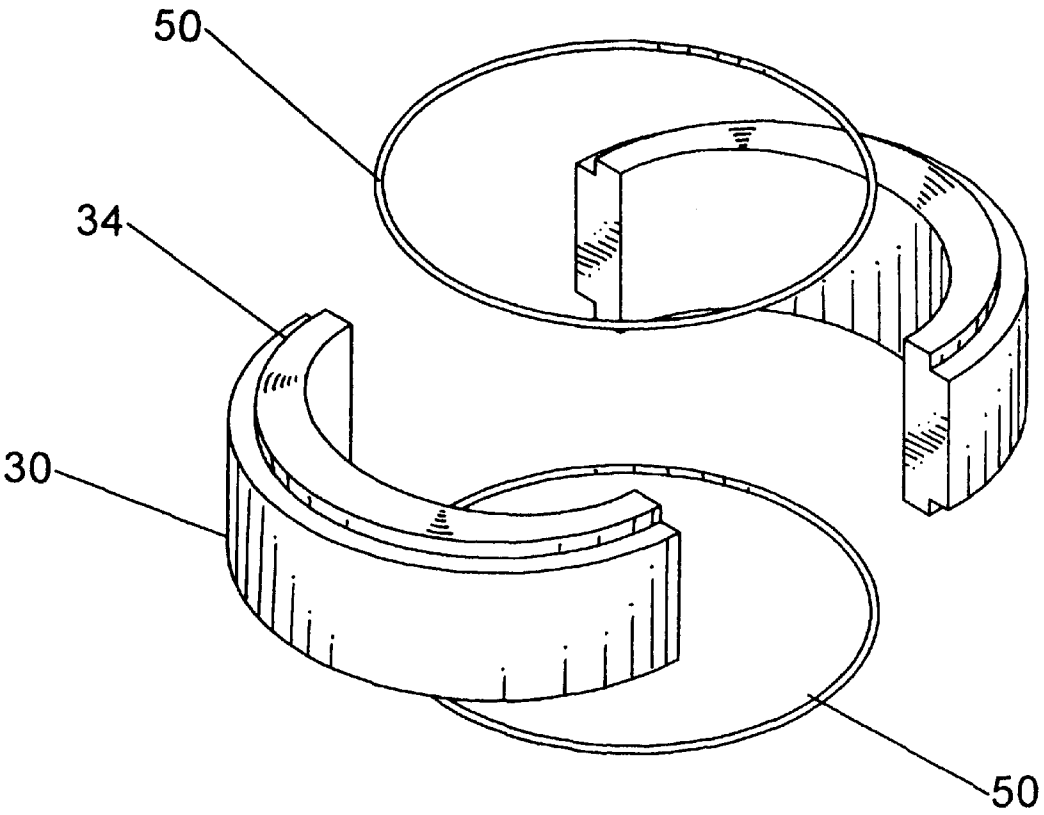
FIG. 6 is a schematic view of the grommet with a pair of spring rings according to the invention.

Referring to FIG. 5, in order to ensure the grommet 30 returning to the original position as the spinner element 20 removes pushing force on the grommet 30, according to the invention, a slot 32 should be formed on, and a camming cylinder 33 is set in the slot 32, and then the separated segments of the grommet 30 are connected by a spring 50. In another way shown as in FIG. 6, a edge-notched 34 on the grommet 30 having separated segments is entangled with a circular spring 50.

The wrench in accordance with the invention has outstanding advantages different from conventional ratchet wrenches, such as D-head ratchet wrench, calabash-form ratchet wrench and non-noise wrench. For these conventional wrenches, the abrasion on the elements may increase the gap between the elements so that error occurs, and more seriously, wrench is even unable to rotate. Therefore, the durability of the wrench is shortened. After using the wrench of the invention for a long time, various elements, such as the pawl, the spinner element and moving parts, also generates the abrasion. Even though the gaps between the elements increase, larger space apart between moving parts can perform to jam the pawl, and to rotate the wrench. As a result, this wrench has longer durability than that of a general ratchet wrench, which is the most outstanding advantage of the wrench according to the invention.

What is claimed is:

1. A one-way driving control mechanism of a wrench comprising: a wrench body, a spinner element, a diameter-variable grommet and a pawl; a head portion of said wrench body having a housing for receiving said spinner element, said diameter-variable grommet and said pawl in it; a middle portion of said spinner element taking the shape of an elliptic cylinder, which is encircled by said diameter-variable grommet; a groove wall designed on the sidewall of said housing coupled with said pawl; said pawl against said groove wall of the housing contacting with the external side of said grommet.

2. A one-way driving control mechanism of a wrench according to claim 1, wherein said diameter-variable grommet is composed of a plurality of separate segments.

3. A one-way driving control mechanism of a wrench according to claim 2, wherein each said segment of the grommet has a slot and a camming cylinder, and said camming cylinders of said each separate segment of the grommet are connected with a spring.

4. A one-way driving control mechanism of a wrench according to claim 2, wherein each said segment of the grommet has an edge-notched, and said edge-notched is entangled with a circular spring.

5. A one-way driving control mechanism of a wrench according to claim 1, wherein symmetrical groove wall are formed in said housing, a direction control element connects with said pawl to control said pawl to move to one of said groove walls, and thereby select a one-way driving control direction.

* * * * *